United States Patent [19]

Braun

[11] Patent Number: 4,951,339

[45] Date of Patent: Aug. 28, 1990

[54] CLEANING MACHINE FOR GOLF CLUBS

[76] Inventor: Stephen C. Braun, 420 Bay Tree La., Longwood, Fla. 32779

[21] Appl. No.: 407,006

[22] Filed: Sep. 14, 1989

[51] Int. Cl.[5] ..... A46B 13/04

[52] U.S. Cl. ..... 15/88.3; 15/88.4

[58] Field of Search ..... 15/21 R, 21 C, 21 D, 15/21 E, 38, 39, 97 R

[56] References Cited

U.S. PATENT DOCUMENTS

| | | | |
|---|---|---|---|
| 1,542,025 | 6/1925 | Ballman | 15/38 |
| 2,036,840 | 4/1936 | Thiesen | 15/39 |
| 3,126,247 | 3/1964 | Miller | 15/39 |
| 3,148,396 | 9/1964 | Smith | 15/21 D |
| 3,648,315 | 3/1972 | Hash | 15/21 D |
| 3,872,534 | 3/1975 | Hoag | 15/21 D |

*Primary Examiner*—Edward L. Roberts

*Attorney, Agent, or Firm*—Malloy & Malloy

[57] ABSTRACT

A motor powered cleaning assembly for the washing of golf club heads including a housing having a power brush rotatably mounted thereon and a removable cleaning fluid containing tray disposed in substantially enclosing relation to the brush wherein the housing and the tray are cooperatively structured for the removable placement and manipulation of the club head therein into a plurality of engaging positions with the rotary brush so as to clean opposite sides thereof as well as the striking face on both left and right-handed clubs.

16 Claims, 2 Drawing Sheets

CLEANING MACHINE FOR GOLF CLUBS

BACKGROUND OF THE INVENTION

1. Field of the Invention

This invention relates to a relatively lightweight, portable but motor powered cleaning assembly for cleaning the striking face and other surfaces of either a right or left-handed golf club and including structure which allows for its disassembly, maintenance and cleaning.

2. Description of the Prior Art

The popularity of golf and accordingly the use of golf clubs has increased continuously over the passed years. However, regardless of the advancement in the clubs, balls, and like paraphernalia, there is still one commonly existing problem since such golf equipment has been used. The cleaning of particularly the golf head and the striking surface of golf clubs has long been a problem associated with the playing of golf. Typically structured manually operated golf ball washers have been in use and are prevalent throughout most golf courses. Such golf ball washers normally include stationary brushes mounted on the interior of an almost entirely enclosed housing in which is located cleaning liquid such as detergent added to water or the like. A plunger is reciprocably moved into and out of the housing and is structured to contain the golf balls therein in scrubbing relation with the bristles of the stationary brush.

The Wyckoff U.S. Pat. No. et al., 4,821,358 and Parchment U.S. Pat. No. et al., 4,734,952 both disclose somewhat similar type of manually operable golf club washers for the washing and/or general cleaning of the head portion and striking surface of golf clubs.

However, increased demand for a more efficient and effective cleaning facility has necessitated the development of power operated washers for the cleaning, scrubbing, polishing, etc. of the striking surface as well as the remainder of the golf club. Such golf club cleaning devices are demonstrated in the Hoag U.S. Pat. No. 3,872,534. Hoag discloses a golf club head washer having a motor driven cylindrical cleaning brushes with opposed intermeshing nylon bristles rotatably mounted in spaced relation on a horizontal axes in a water-sealed tank which is considered to be a part of the housing. Hoag, while intended to be operable includes a plurality of brushes, a complicated mechanically detailed driving and brush system and a somewhat large, heavy, bulky cabinet and support mechanism.

Similarly, Hash U.S. Pat. No. 3,648,315 discloses a golf club cleaner having a plurality of washing and/or polishing brushes and like structures on an elongated horizontal motor driven axes wherein at least one of the brushes is disposed on the interior of a cabinet containing cleaning liquid or fluid therein.

The patent to Varrial U.S. Pat. No. 4,541,138 discloses a golf club head cleaning machine using two pairs of cylindrical brushes wherein the brushes of each pair operate in close proximity. The bristles of the brush pairs move in opposite directions in order to reduce the structural load. Again, while operable, the Varrial structure is somewhat bulky, heavy, and extremely complex requiring a plurality of moving parts and interconnecting and supporting components and linkage to operate the device effectively.

None of the above set forth devices disclose a lightweight easily transportable device capable of adequately cleaning all surfaces of a club head, including the striking surface or face thereof whether the club is right-handed or left-handed and further wherein such a preferred structure may include a removable tray which may be easily replenished with cleansing liquid and/or replaced or repaired when such activities are found necessary.

SUMMARY OF THE INVENTION

The present invention relates to a cleaning or washing assembly for the heads of golf clubs and comprises a housing having a hollow interior and including a tray removably attached thereto for the containment of a cleaning liquid. Further, the tray is selectively detachable from its operative position on the housing such that the cleaning fluid can be replaced and further wherein access to other components of the subject assembly, such as the cleaning or washing brush is made easier. The brush means is in the form of a power driven preferably single brush member rotationally mounted on the housing and driven by an electrically powered drive motor. The tray includes an open mouth through which the brush may pass when the tray is disposed in its mounted, operative position on the housing. Therefore, the brush is disposed essentially on the interior of the tray and in direct contact with the cleaning liquid maintained on the interior of the tray. A channel means is formed in an exposed face of the housing and is dimensioned to allow passage therethrough of at least the head portion of a golf club. When so positioned, the golf club head, to be cleaned, is also disposed on the interior of the tray in at least partially submerged or contacting relation with the cleaning fluid and in direct engageable relation with the cleaning brush.

The channel means includes at least one elongated channel having two spaced apart channel segments wherein the channel is dimensioned and configured, along with the specifically disposed channel segments to allow versatility in positioning the club head and specifically in orienting the club head relative to the rotating cleaning brush.

More specifically, the channel, placement of the brush and structural configuration and dimension of the tray means allows for either a right-handed or left-handed golf club to be cleaned and further, allows for essentially the entire exposed surface of the club head to be cleaned since the golf club can be manipulated along the length of the channel and into and out of each of the channel segments such that all surfaces including the contact surface of the club head is exposed in cleaning engagement with the outer surface of the club head.

A control means in the form of a switch assembly is electrically connected to the drive motor and serves to regulate electrical current flow between a conventional power source and the drive motor itself. Such switch assembly may be in the form of a "pedal" which may be foot-operated and, when depressed, by the foot, or otherwise moved to a "on" position, serves to activate the drive motor and accordingly, rotate the cleaning fluid within the interior of the tray means.

Other features associated with the cleaning or washing assembly of the present invention includes an elongated splash guard mounted to the housing and in overlying, covering relation to the channel along its length and in covering relation relative to the interior of the tray means. The splash guard is formed from a flexible material and allows easy passage therethrough of the club head to be cleaned. An elongated slit is formed in the flexible material splash guard so as to allow positioning and travel of the club head along the length of the channel effectively beneath the splash guard.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
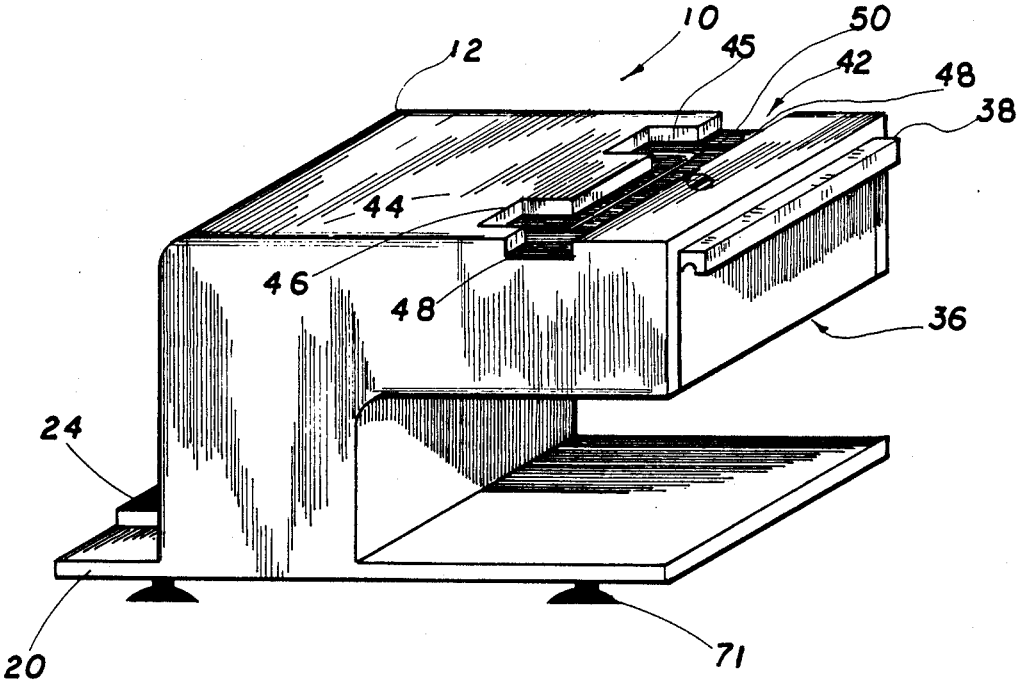
FIG. 1 is a perspective view of the assembly of the present invention.
Figure 2:
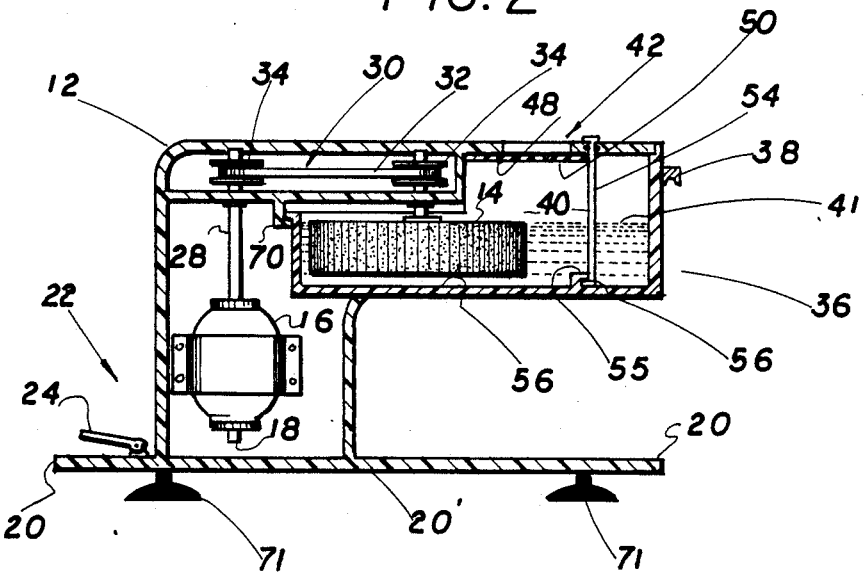
FIG. 2 is a transverse sectional view of the embodiment of FIG. 1.

As shown in the accompanying figures, the present invention relates to a cleaning assembly generally indicated as 10 for a golf club and particularly the head portion of the club. The assembly comprises a housing 12 having mounted thereon a brush means in the form of preferably one cleaning brush 14 rotationally driven and powered by a drive motor 16. The drive motor 16 is electrically powered through conventional conductors and the like 18 and is thereby connected to a conventional electrical A.C. or D.C. power source. A control means is provided and mounted on the housing 12 and more particularly on an exposed based portion thereof as at 20. The control means generally indicated as 22 includes a foot operated switch as at 24 in the form of a pedal or the like. The pedal, serving as a switch, regulates current flow from the aforementioned conventional source of electrical power through the conductor 18 to the electrically powered drive motor 16. Once activated, a drive shaft 28 serves to drive and rotate a linkage assembly generally indicated as 30 which may include a drive belt 32 interconnected between a pair of pulleys as at 34. The cleaning brush 14 is thereby rotationally driven. The housing further includes a tray means generally indicates as 36 having an exterior handle or gripping portion 38 and a substantially hollow interior as at 40. The hollow interior 40 as well as the configuration and dimension of the tray means 36 is such as to at least partially enclose the cleaning brush 14 and also contain a cleaning fluid such as water mixed with detergent as at 41. When the tray means 36 is in its operative position as shown in FIGS. 1 and 2, the brush 14 is at least partially submerged or at least is disposed to establish significant contact with the cleaning fluid 41 as well as the surface of the club head when such club head is disposed within the interior 40.

Access of the club head into the interior 40 of the tray 36 is accomplished by the provision of an elongated channel means generally indicated as 42 integrally formed in an upper exposed face 44 of the housing 12. The channel means 42 includes two channel segments or slots 45 and 46 disposed in spaced apart relation to one another and specifically disposed relative to the placement of the cleaning brush 14. In order to prevent the cleaning fluid 41 from exiting the interior 40 of the tray means 36 during the cleaning operation, such as when the brush 14 is rotating, a splash guard 48 is disposed in covering relation to the channel means 42 relative to the interior 40 of the tray means 36 and the cleaning fluid 41 contained therein.

Figure 3:
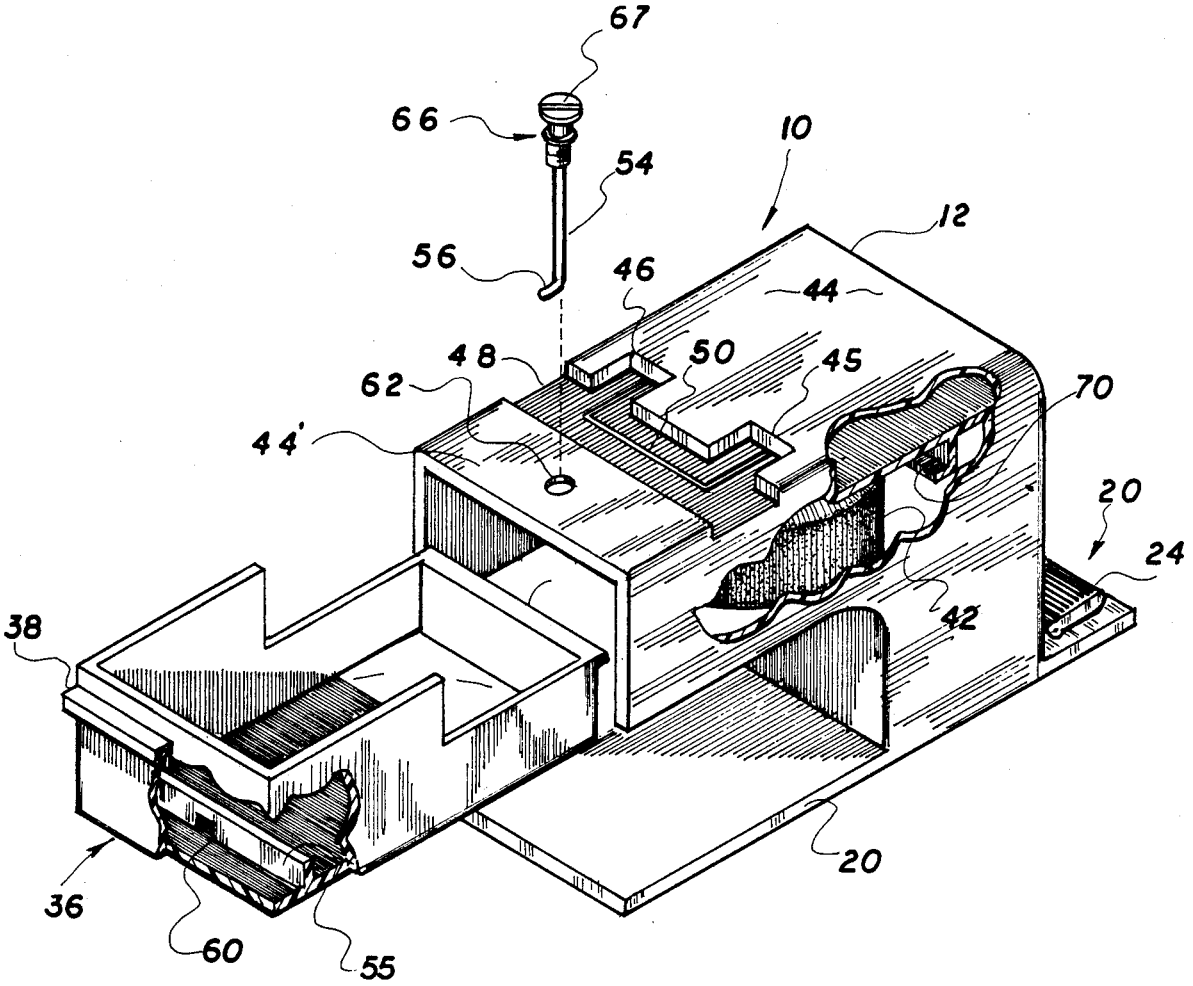
FIG. 3 is a perspective view in partial cutaway and in exploded form.

The splash guard 48 is formed from a flexible material and further includes an elongated slit 50 extending along a majority of the length of the splash guard 48 and specifically positioned to extend along the slot 45 and 46 (see FIG. 3). The flexibility of the splash guard 48 and the disposition and dimension of the slot 50 is such as to allow the head to pass therethrough into the interior 40 of the tray means 36 and into contact with both the brush 14 and the cleaning fluid 41. Further, the configuration and placement of the slit 50 allows the user of the assembly 10 to manipulate the club head, once within the interior 40, such that all effective surfaces, including the striking surface or face of the club head, comes in direct contact with the rotating cleaning brush 14. Therefore, it should be readily apparent that both right and left-handed golf clubs may be readily cleaned and regardless of the overall configuration of the club head practically all the exposed surface area thereof may come in contact with the brush 14 and of course the cleaning fluid 41.

Other features of the present invention include a locking means for the removable attachment of the tray means 36 to the housing 12. Such connecting means includes an elongated locking or connecting element 54 having a distal end 56 configured, when rotated, to lockingly engage a locking strip or member 55 formed on the interior 40 of the tray means 36. The member 55 further functions as a stop to stabilize the club head where engaged by the brush. Such strip, in a preferred embodiment, may be integrally formed to extend upwardly from the inner surface as at 56 of the interior 40 of the tray means and may further include a cutout or notched portion as at 60. The notched portion is specifically disposed to receive the distal end 56 which is configured to be rotated into a supporting, retaining engagement within the notch 60 of the connecting or locking member 54. An aperture as at 62 is formed in the exposed upper surface 44' of the housing 12 and is dimensioned to receive the enlarged head 66 defining the proximal end of the connecting member 54. The head 66 may be structured to include a cross slot 67 for the receipt of a screwdriver or like tool thereby facilitating the rotation of the member 54. Other features which help maintain the tray means 36 in its operative position is an outwardly extending lip or flange 68 secured to a rear portion of the tray means 36. This flange 68 is designed to rest on a depending lip or flange 70 formed on the interior of the housing 12 effectively behind the rotating brush 42.

Yet other features of the present invention include mounting means such as suction cups or the like 76 attached to the undersurface 20' of the base 20 and disposed to secure the housing 12 to any type of supporting surface during the operation of the assembly.

Now that the invention has been described,

What is claimed is:

1. A cleaning assembly for golf club heads, said assembly comprising:

(a) a housing including a hollow interior portion and a brush means rotatably mounted therein for cleaning the heads of golf clubs coming in contact therewith, (b) channel means formed in said housing in communicating relation with said brush means for positioning the club head relative to said brush means, (c) a tray means structured for holding cleaning liquid therein and removably attached to said housing, (d) said tray means including a chamber dimensioned and structured to at least partially receive said brush means therein and dimensioned and structured for adjacent, cooperative positioning of the brush means, cleaning fluid and club head within said chamber during a cleaning operation, (e) motor means mounted on said housing in driving connection to said brush means, and (f) control means electrically connected in current regulating relation between a source of electrical power and said motor means.

2. An assembly as in claim 1 wherein said tray means comprises a substantially hollow chamber dimensioned and configured to receive and substantially enclose said brush means on the interior thereof.

3. An assembly as in claim 2 further comprising a stop structure formed in said chamber adjacent said brush means and disposed to stabilize the club head when engaged by said brush.

4. An assembly as in claim 3, wherein said stop member comprises an elongated outwardly extending projection formed on a floor portion of said chamber and disposed to abut against a club head being cleaned and thereby dispose the club head between said stop structure and the brush means.

5. An assembly as in claim 1 wherein said channel means is formed in an exposed face of said housing in communicating relation within said chamber and said brush means therein.

6. An assembly as in claim 5 wherein said channel means is formed in an upper, exposed face of said housing, the club head passing vertically downward through said channel means into said chamber and into engagement with said brush means.

7. An assembly as in claim 6 wherein said brush means comprises a rotary mounted, power driven brush disposed and configured to rotate about a substantially vertical axis.

8. An assembly as in claim 7 wherein said tray comprises an open mouth communicating directly with and defining access to said chamber, said open mouth dimensioned to receive said brush means therethrough.

9. An assembly as in claim 6 wherein said tray comprises a locking means attached thereto and structured for removable locking engagement with said housing and support of said tray means beneath said upper exposed face.

10. An assembly as in claim 9 wherein said locking means comprises an elongated connector element disposed to have one upper end secured to said upper exposed face and an opposite end passing through said face into removable gripping engagement with said tray means on the interior of said chamber.

11. An assembly as in claim 5 wherein said channel is configured and dimensioned to receive a club head therein in a plurality of orientations sufficient to expose opposite sides of the club head into cleaning engagement with said brush means.

12. An assembly as in claim 11 wherein said channel means comprises a first slot and a second slot disposed in spaced relation to one another and interconnected by a connecting channel extending therebetween.

13. An assembly as in claim 12 wherein said first slot and said second slot are positioned and configured to dispose opposite sides of the club head in cleaning engagement with said brush means.

14. An assembly as in claim 13, wherein said first slot and said second slot are positioned and configured to dispose a striking face of a right-handed club and a left-handed club of the club head respectively in cleaning engagement with said brush means.

15. An assembly as in claim 14 further comprising a splash guard extending along the length of both said first and second slots and said connecting channel.

16. An assembly as in claim 15 wherein said splash guard comprises an elongated flexible material member having an elongated centrally disposed slot extending along the length thereof.

* * * * *